US007461451B2

(12) United States Patent
Igarashi et al.

(10) Patent No.: US 7,461,451 B2
(45) Date of Patent: Dec. 9, 2008

(54) METHOD FOR MANUFACTURING LIQUID DISCHARGE HEAD

(75) Inventors: Koichi Igarashi, Kanagawa (JP); Minoru Kohno, Tokyo (JP); Manabu Tomita, Kanagawa (JP); Shogo Ono, Kanagawa (JP); Takaaki Murakami, Kanagawa (JP)

(73) Assignee: Sony Corporation, Tokyo (JP)

( * ) Notice: Subject to any disclaimer, the term of this patent is extended or adjusted under 35 U.S.C. 154(b) by 301 days.

(21) Appl. No.: 11/119,228

(22) Filed: Apr. 29, 2005

(65) Prior Publication Data

US 2005/0190234 A1 Sep. 1, 2005

Related U.S. Application Data

(62) Division of application No. 10/480,241, filed as application No. PCT/JP03/04523 on Apr. 9, 2003, now Pat. No. 7,137,687.

(30) Foreign Application Priority Data

Apr. 10, 2002 (JP) ..... P2002-107295
Apr. 10, 2002 (JP) ..... P2002-107322

(51) Int. Cl.
*B21D 53/76* (2006.01)

(52) U.S. Cl. ..... 29/890.1; 29/832; 29/856; 29/848; 29/611; 347/45

(58) Field of Classification Search ..... 29/890.1, 29/832, 856, 848, 611; 347/47, 63, 56, 20, 347/61–65, 67; 216/27, 36; 264/477, 478; 430/302

See application file for complete search history.

(56) References Cited

U.S. PATENT DOCUMENTS

| | | | | |
|---|---|---|---|---|
| 5,126,768 | A * | 6/1992 | Nozawa et al. | 347/65 |
| 5,498,306 | A * | 3/1996 | Shibata et al. | 156/275.3 |
| 5,758,417 | A * | 6/1998 | Kobayashi et al. | 29/890.1 |
| 5,760,803 | A * | 6/1998 | Yamamoto et al. | 347/47 |
| 5,808,644 | A * | 9/1998 | Imamura et al. | 347/93 |
| 6,626,521 | B1 * | 9/2003 | Nozawa | 347/63 |

FOREIGN PATENT DOCUMENTS

| | | |
|---|---|---|
| EP | 0 500 068 A2 | 8/1992 |
| EP | 0 899 110 A2 | 3/1999 |
| JP | 61-154947 | 7/1986 |
| JP | 62-253457 | 11/1987 |
| JP | 01-195050 | 8/1989 |
| JP | 03-184868 | 8/1991 |
| JP | 05-212870 | 8/1993 |
| JP | 06-286149 | 10/1994 |
| JP | 07-214783 | 8/1995 |
| JP | 2002-001958 | 1/2002 |

* cited by examiner

*Primary Examiner*—David P Bryant
*Assistant Examiner*—Tai Nguyen
(74) *Attorney, Agent, or Firm*—Rockey, Depke & Lyons, LLC; Robert J. Depke

(57) ABSTRACT

The present invention fixes a nozzle sheet on a substrate with a predetermined material (5,6), which has an excellent chemical resistance and sufficient adhesiveness, or more specifically, fixes the nozzle sheet on the substrate with cyclized rubber or with patternable, adhesive elastic material. Moreover, the present invention forms walls for liquid chambers and liquid channels with polyimide.

3 Claims, 12 Drawing Sheets

(F)

(G)

(H)

(F)

(G)

(H)

(I)

METHOD FOR MANUFACTURING LIQUID DISCHARGE HEAD

The subject matter of application Ser. No. 10/480,241 is incorporated herein by reference. The present application is a divisional of U.S. application Ser. No. 10/480,241, filed Dec. 9, 2003, now U.S. Pat. No. 7,137,687 which claims priority to Japanese Patent Application Nos. JP2002-107295, filed Apr. 10, 2002 and JP2002-107322, filed Apr. 10, 2002 and International Application No. PCT/JP03/04523 filed on Apr. 9, 2003. The present application claims priority to these previously filed applications.

BACKGROUND OF THE PRESENT INVENTION

1. Technical Field

The present invention relates to a liquid discharge head, a liquid discharge apparatus, and a method for forming the liquid discharge head, and may be included in an inkjet printer. The present invention effectively prevents decrease in reliability with use by fixing a nozzle sheet on a substrate with a predetermined material that has an excellent chemical resistance and sufficient adhesiveness, or more specifically, by fixing the nozzle sheet on the substrate with cyclized rubber or with patternable, adhesive elastic material. Moreover, the present invention may effectively prevent a decrease in reliability by forming walls for liquid chambers and liquid channels with polyimide.

2. Background Art

In general, inkjet printers print desired images on printing stock, such as paper, by discharging ink droplets from a printer head onto the printing stock such as paper.

The printer head included in the printer drives driving elements to change the pressure inside the liquid chambers so that the ink contained in the liquid chambers is discharged from nozzles as ink droplets. The driving elements may be heater elements or piezoelectric elements. Walls of the liquid chambers and the liquid channels are intricately formed with a resin such as epoxy resin or acrylic resin (Japanese Unexamined Patent Application Publication Nos. 61-154947, 62-253457, 3-184868, 6-286149, and 7-214783).

In other words, the printer head is formed by, for example, a semiconductor manufacturing process, wherein, on the semiconductor substrate, driving circuits for driving the driving elements are simultaneously formed with the driving elements for changing the pressure inside the liquid chambers. Then, after a photosensitive epoxy resin is spin coated on the semiconductor substrate, the walls of the liquid chambers and the liquid channels are formed on the photosensitive epoxy resin by photolithography. In another process, a sheet including nozzles (hereinafter referred as a 'nozzle sheet') formed by, for example, electrotyping is disposed on the semiconductor substrate.

On the printer head, the nozzle sheet is thermocompressed to the photosensitive epoxy resin that forms the walls of the liquid chambers and the liquid channels.

For known printer heads, the reliability gradually decreases with use.

More specifically, for known printer heads, the resin such as epoxy resin forming the walls of the liquid chambers and the liquid channels erodes and swells with use. This erosion and swelling decreases the adhesive strength between the nozzle sheet and the end faces of the walls. Therefore, in the worst case, gaps form between the nozzle sheet and the end faces of the walls of neighboring liquid chambers, causing crosstalk between these liquid chambers.

In particular, when the nozzle sheet is formed of metal such as nickel or heat-resistant polyimide, the adhesive strength between the nozzle sheet and the end faces of the walls is low from the beginning, causing even more gaps to form and worsening the crosstalk.

When crosstalk occurs between the neighboring liquid chambers of the printer head, the printing performance, such as resolution of the printer, is greatly reduced, making it difficult to print high-resolution images.

DISCLOSURE OF INVENTION

In consideration of the above problems, the present invention provides a liquid discharge head, a liquid discharge apparatus and a method for forming a liquid discharge head that can effectively prevent a decrease in reliability with use.

To solve the above problems, the present invention provides a liquid discharge head, wherein the pressure inside the liquid chambers is changed by driving elements and wherein droplets of liquid contained in the liquid chambers are discharged from predetermined nozzles. The driving elements are disposed on a substrate, which has walls forming the liquid chambers and the liquid channels for supplying liquid to the liquid chambers. On the walls of the liquid chambers and the liquid channels, a nozzle sheet, which includes nozzles, is bonded. At least the bonding surfaces of the walls and the nozzle sheet should be chemically resistant to the liquid and may be formed with a predetermined material that sufficiently adheres to the nozzle sheet.

According to the present invention, the liquid discharge head has driving elements for changing the pressure inside the liquid chambers and discharges droplets of liquid contained in the liquid chambers from predetermined nozzles. The liquid discharge head may be applied to various devices such as the following: printer heads using liquids such as ink, various dyes, or liquid for forming protective layers; micro-dispensers, various measuring devices, and various test equipment using liquids such as reagents; or pattern-making devices using liquids such as chemical agents for etching protection. According to the present invention, the driving elements are disposed on a substrate, which has walls forming liquid chambers and liquid channels for supplying liquid to the liquid chambers. On the walls of the liquid chambers and the liquid channels, the nozzle sheet with the nozzles is bonded. At least the bonding surface of the walls and the nozzle sheet should be chemically resistant to the liquid and should be formed with a predetermined material that sufficiently adheres to the nozzle sheet. As a result, a decrease in reliability with use is effectively prevented.

For the liquid discharge head according to the present invention, the predetermined material may be cyclized rubber.

The cyclized rubber used as the predetermined material for the liquid discharge head according to the present invention has an excellent chemical resistance and elasticity, is easily processed into intricate shapes by patterning, and has sufficient adhesiveness even when the nozzle sheet is formed of nickel. Consequently, the nozzle sheet may be attached firmly. Also, if the resin forming the walls swells, the portion to which the cyclized rubber is attached deforms. This deformation, however, may be absorbed, and, as a result, a decrease in reliability with long-term use is effectively prevented. The occurrence of crosstalk between neighboring liquid chambers is prevented during long-term use. When cyclized rubber is used for the printer head, high-resolution images may be printed.

The predetermined material used for the liquid discharge head according to the present invention may be a patternable, adhesive elastic material.

By using a patternable, adhesive elastic material for the liquid discharge head according to the present invention, the nozzle sheet may be attached firmly. Also, if the resin forming the walls swells, the portion to which the cyclized rubber is attached deforms. This deformation, however, may be absorbed, and, as a result, a decrease in reliability with long-term use is effectively prevented. The occurrence of crosstalk between neighboring liquid chambers is prevented during the long-term use. When cyclized rubber is used for a printer head, high-resolution images may be printed.

The liquid discharge head according to the present invention has walls made of predetermined material formed on the substrate and the nozzle sheet is bonded to the end faces of these walls. The predetermined material may be polyimide.

The liquid discharge head according to the present invention has, on the substrate, walls of the liquid chambers and the liquid channels for supplying liquid to the liquid chambers made of the predetermined material. The nozzle sheet is bonded onto the end faces of these walls. Since polyimide, which has excellent chemical resistance, is used as the predetermined material, swelling and erosion is prevented. As a result, a decrease in reliability with long-term use is effectively prevented. The occurrence of crosstalk between neighboring liquid chambers is also prevented during long-term use. When polyimide is used for the printer head, high-resolution images may be printed. Polyimide has sufficient adhesiveness and, thus, it has sufficient reliability. Polyimide, which is photosensitive, may be intricately processed by being irradiated with activation energy. Block-copolymerized polyimide easily exhibits various desired properties, and, consequently, it can be used with sufficient reliability for various types of processing such as printing.

A liquid discharge apparatus according to the present invention includes a liquid discharge head for attaching droplets of liquid to printing stock. The liquid discharge head changes the pressure inside the liquid chambers with driving elements and discharges droplets of liquid contained in the liquid chambers from predetermined nozzles. The driving elements are disposed on a substrate, which has liquid chambers and liquid channels for supplying liquid to the liquid chambers. The nozzle sheet with the nozzles is bonded on the walls of the liquid chambers and liquid channels. At least the bonding surfaces of the walls and the nozzle sheet should be chemically resistant to the liquid and may be formed with a predetermined material that sufficiently adheres to the nozzle sheet.

For the above liquid discharge apparatus according to the present invention, the predetermined material may be cyclized rubber.

The predetermined material used in the liquid discharge head according to the present invention may be a patternable, adhesive elastic material.

The liquid discharge apparatus according to the present invention has walls made of the predetermined material on the substrate and the nozzle sheet is bonded to the end faces of the walls. The predetermined material may be polyimide.

As a result, the present invention provides a liquid discharge apparatus that effectively prevents a decrease in reliability with long-term use.

By applying a method for forming a liquid discharge head according to the present invention, a liquid discharge head may be formed wherein the pressure inside the liquid chambers are changed with the driving elements and droplets of liquid contained in the liquid chambers are discharged from predetermined nozzles formed on the nozzle sheet. The driving elements are disposed on a substrate with liquid chambers and liquid channels for supplying liquid into the liquid chambers. The nozzle sheet with nozzles is bonded on the walls of the liquid chambers and the liquid channels. At least the bonding surface of the walls and the nozzle sheet should be chemically resistant to the liquid and may be formed with a predetermined material that sufficiently adheres to the nozzle sheet. The nozzle sheet is bonded to the end faces of the walls.

The predetermined material for the method for forming the liquid discharge head according to the present invention may be cyclized rubber.

The predetermined material for the method for forming the liquid discharge head according to the present invention may be a patternable, adhesive elastic material.

According to the method for forming the liquid discharge head according to the present invention, the walls are made of the predetermined material and formed on the substrate, and the nozzle sheet is bonded to the end faces of the walls. The predetermined material may be polyimide.

As a result, the invention provides a liquid discharge apparatus that effectively prevents a decrease in reliability with long-term use.

BEST MODE FOR CARRYING OUT THE INVENTION

Figure 1:
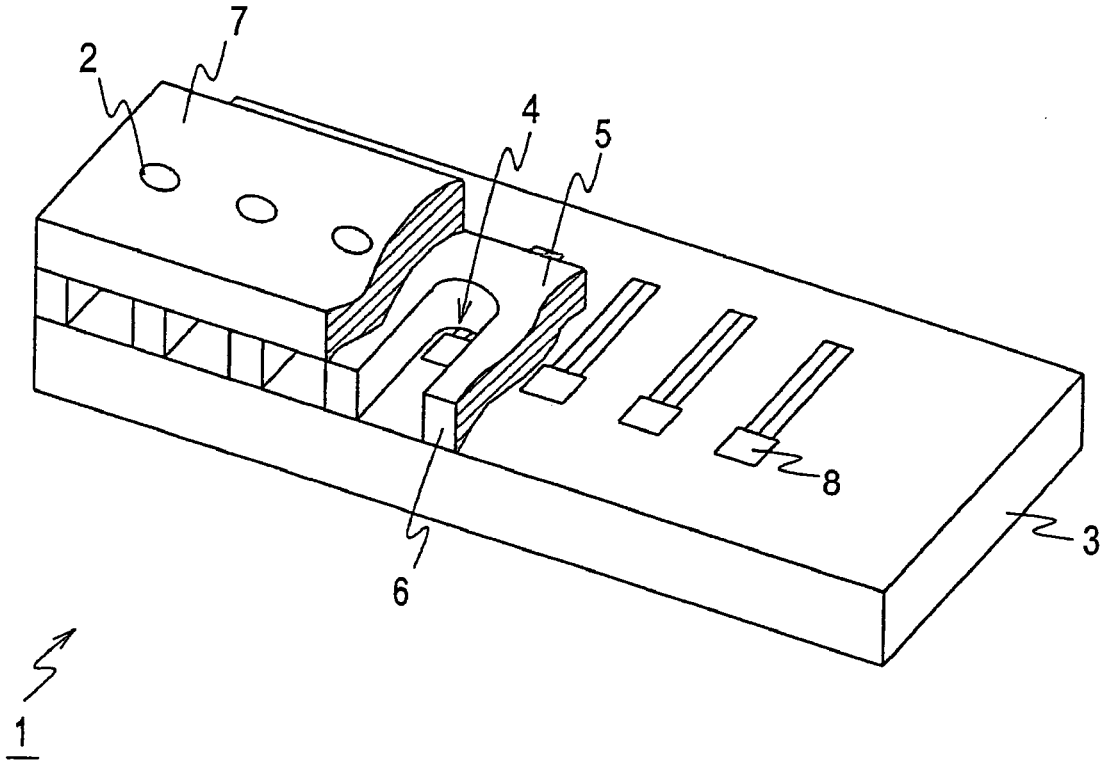
FIG. 1 is a perspective view of a printer head according to a first embodiment of the present invention.
Figure 2:
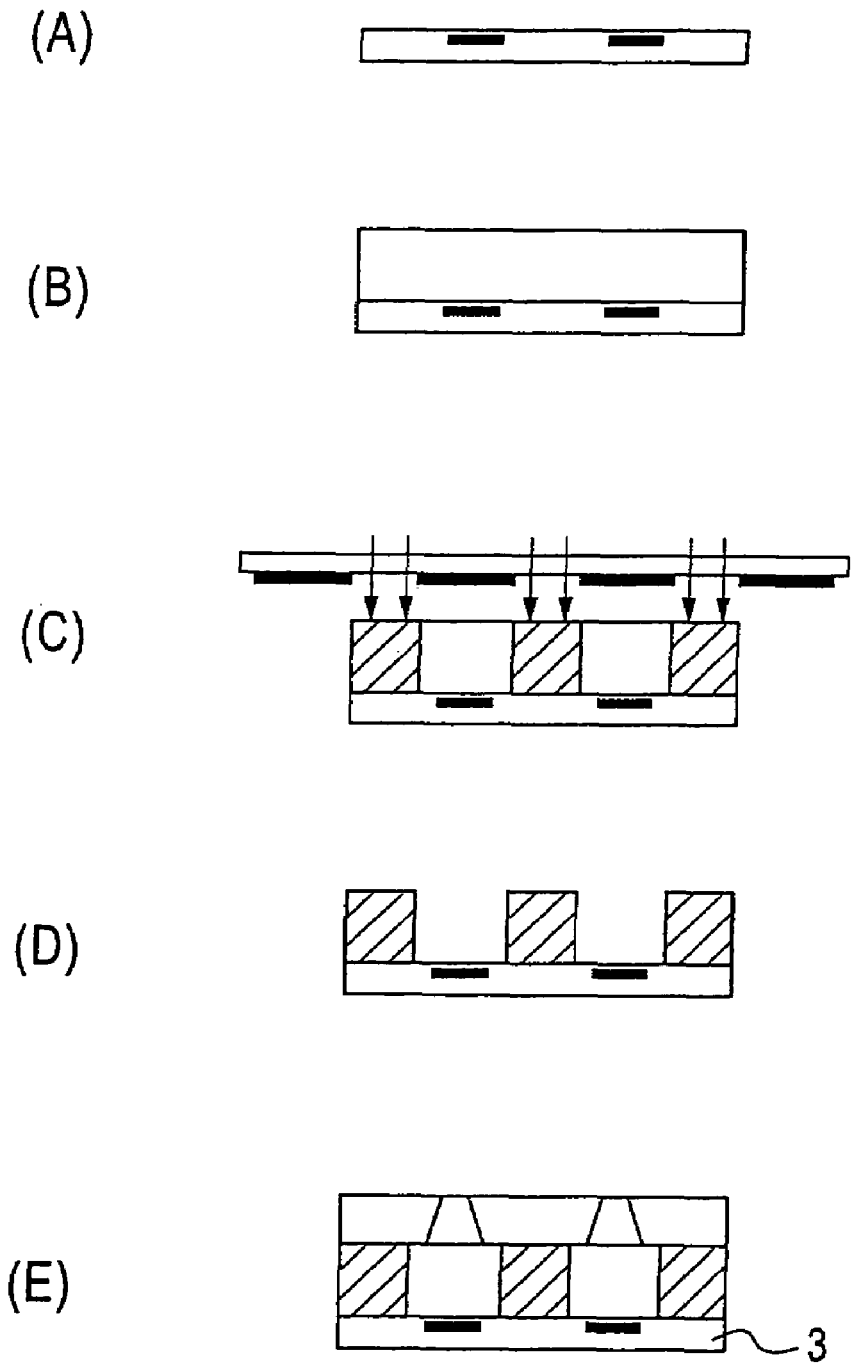
FIGS. 2(A), 2(B), 2(C), 2(D), and 2(E) are perspective views of the manufacturing process of the printer head of FIG. 1.

Embodiments of the present invention are described below by referring to the drawings as necessary.

(1) First Embodiment (1-1) Arrangement of the First Embodiment

FIG. 1 is a perspective view including cross-sectional views of some portions of a printer head included in a printer according to a first embodiment of the present invention. The printer has a printer head 1, which discharges ink droplets onto printing stock to print desired images.

The printer head 1 is a printer head for a full line printer with a plurality of nozzles 2 arranged over the width of paper, which is the printing stock. The nozzles 2 are arranged in a line over the width of the paper. Each line of nozzles is predetermined to a particular color of ink. As a result, the printer head 1 can print color images.

FIG. 1 is a perspective view showing a portion of the line of nozzles on the printer head 1. The printer head 1 includes, on a substrate 3, walls 5 of liquid chambers 4 containing ink, walls 6 of a liquid channel for supplying ink into the liquid chambers 4, and a nozzle sheet 7 formed on these walls.

The substrate 3 is formed by a semiconductor manufacturing process, wherein heater elements 8, which are driving elements for changing the pressure inside the liquid chambers 4, and driving circuits for driving these heater elements 8 are simultaneously formed on a silicon wafer. The wafer is divided into substrates 3, having predetermined shapes. Consequently, the printer head 1 changes the pressure inside the liquid chambers 4 by the heater elements 8, which are driving elements for changing the pressure inside the liquid chambers 4, and discharges droplets of ink contained in the liquid chambers 4 from the nozzles 2 onto printing stock.

The nozzle sheet 7 is a nickel sheet, which is formed by electrotyping, or a polyimide sheet with heat resistance. The nickel nozzle sheet 7 formed by electrotyping allows the fine nozzles 2 to be easily formed with high precision. The polyimide nozzle sheet 7 has excellent chemical resistance, providing high reliability.

The walls 5 and 6 are entirely formed of patternable, adhesive elastic material. Thus, on the printer head 1, the nozzle sheet 7 is attached onto the substrate 3 with this patternable, adhesive elastic material. As a result, a decrease in reliability with use is effectively prevented.

In particular, the walls 5 and 6 are formed with polyisoprene rubber, which is cyclized rubber. Here, polyisoprene rubber is partly cyclized natural or synthetic cis-1,4-polyisoprene and has characteristics such as strong adhesiveness, stable quality, and high chemical resistance.

Cyclized rubber is a photosensitive resist. The cyclized rubber, which is a photosensitive resist, is a highly reliable material with a long history of being used as a rubber resist. Further, cyclized rubber is a highly polymerized compound including unsaturated double bonds in the molecule and is a material widely used for photofabrication. Here, 'photofabrication' is a generic term for the technology used for manufacturing various precision components by applying an electroforming technique or a combination of these techniques mainly based on techniques such as chemical etching, electrolytic etching, or electroplating, which uses, as masks, resist films patterned by photolithography techniques. Photofabrication is currently the mainstream technology for precision processing. In this embodiment, cyclized rubber is patterned by photolithography, and the walls 5 and 6 are intricately formed with high precision.

As cyclized rubber that is a photosensitive resist, rubber resists made of polyisoprene or polybutadiene may be used. More specifically, Fuji Film Arch's SC Series, IC-T3 Series, HR Series, HNR Series, or VHR-2, Tokyo Ohka Kogyo's EPPR Series, or Zeon Corporation's ZPN103-39 may be used.

FIGS. 2(A) to 2(E) are cross-sectional views describing the manufacturing process of the printer head 1. In the manufacturing process, the heater elements 8 are formed on the silicon substrate 3 by a semiconductor manufacturing process (FIG. 2 (A)). The surface of the substrate 3 is treated or modified as required. Then a material layer is disposed on the substrate 3 to improve the adhesive strength between the substrate 3 and the walls 5 and 6. The material layer disposed to improve the adhesive strength should be made of a material extensively used for this type of processing.

As shown in FIG. 2(B), a resist made of photosensitive cyclized rubber is applied onto the substrate 3 with a predetermined thickness, forming a resist layer 11. To apply the resist layer 11, various application methods used in semiconductor manufacturing processing, such as spin coating, bar coating, or curtain coating may be used. The thickness of the resist layer 11 is arranged so that the final height of the liquid chambers 4 becomes the desired value.

As shown in FIG. 2(C), the resist layer 11 made of photosensitive cyclized rubber is selectively exposed to activation energy 12. In FIG. 2(C), the exposed area is indicated by reference number 11A. The activation energy 12 may be ultraviolet rays, electron beams, or X-rays, depending on the property of the resist. In this embodiment, ultraviolet rays exposure equipment is used to irradiate the resist layer 11 made of cyclized rubber photosensitive to 280 [nm] to 480 [nm] with ultraviolet rays. In FIG. 2(C), reference number 13 indicates a photomask.

As shown in FIG. 2(D), the resist layer 11 is developed using specific liquid developers and solvents. Then the unexposed areas are removed from the resist layer 11. By photolithography using the activation energy 12, and walls 5 and 6 of the liquid chambers 4 the liquid channels are patterned onto the cyclized rubber.

As shown in FIG. 2(E), the nozzle sheet 7 is positioned and pressure-fixed. The nozzle sheet 7 is held by the adhesiveness of the patterned material (hereinafter referred to as 'secondary adhesiveness'). The nozzle sheet 7 may simply be pressed to be bonded. Further, after the nozzle sheet 7 is attached to the cyclized rubber, its adhesive strength may be strengthened by supplying energy such as heat, light, or an electron beam. The energy such as heat, light, or an electron beam may be supplied while the nozzle sheet 7 is pressed.

The cyclized rubber 11A forming the walls 5 and 6 fixes the nozzle sheet 7 to the substrate 3. Then the cyclized rubber 11A is cured by baking to form a strong rubber film on cyclized rubber 11B. Curing of the cyclized rubber 11A may be performed before or while attaching the nozzle sheet 7. When curing is performed before attaching the nozzle sheet 7, it is necessary to make sure that the cyclized rubber has enough adhesive strength to attach the nozzle sheet 7.

Figure 3:
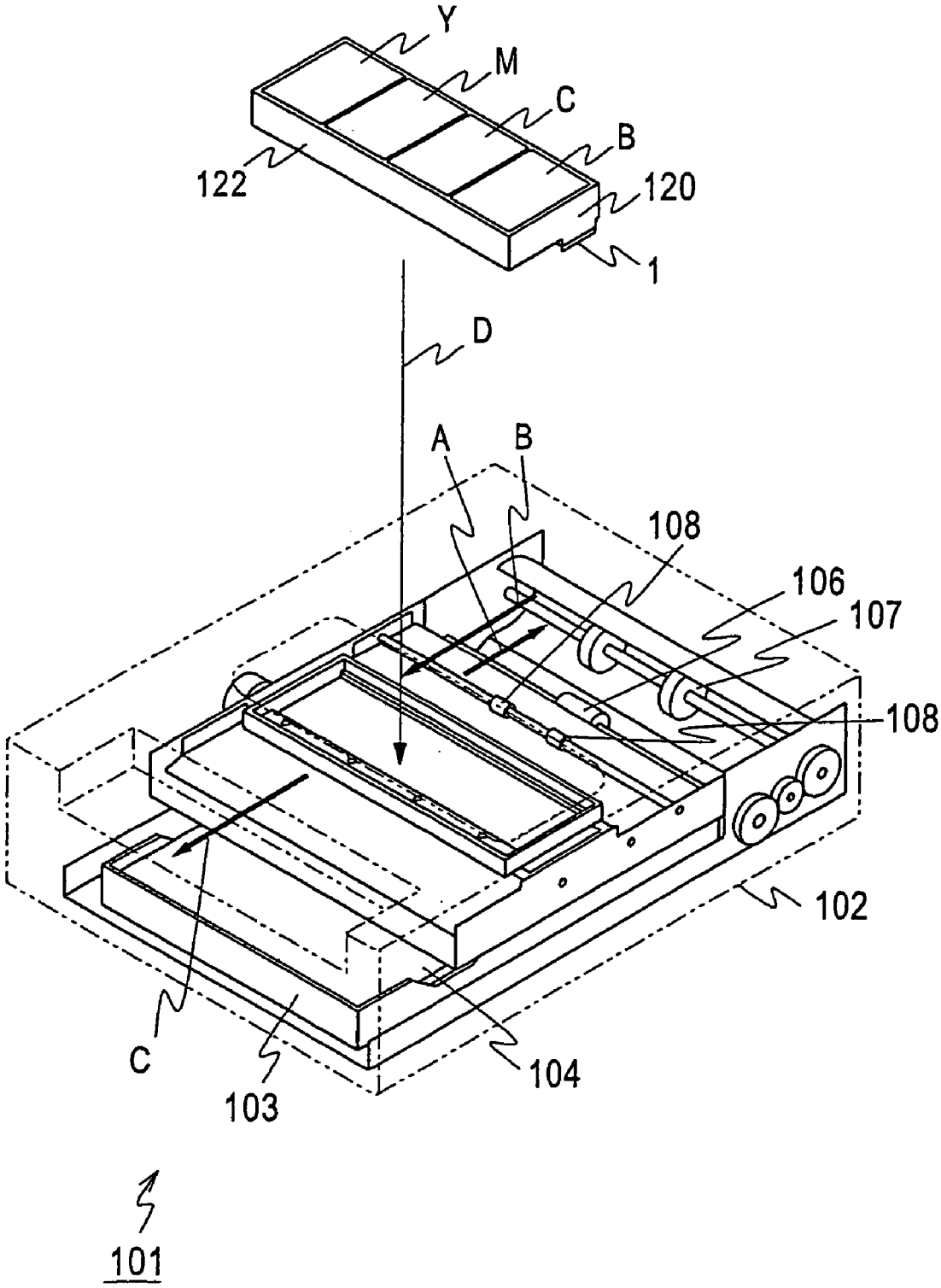
FIG. 3 is a perspective view of a line printer using the printer head of FIG. 1.

FIG. 3 is a perspective view of a line printer having the printer head 1.

A line printer 101 is fully contained in a rectangular chassis 102. A paper tray 103 containing paper 104, which is the recording medium, is inserted from a tray inlet formed on the front of the chassis 102, allowing the paper 104 to be fed.

The paper tray 103 is installed into the line printer 101 from the tray inlet. Then a mechanism pushes the paper 104 against a paper-feeding roller 106. The rotation of the paper-feeding roller 106 causes the paper 104 to be pulled out from the paper tray 103 towards the back of the line printer 101, as indicated by arrow A. On the back of the line printer 101, reverse rollers 107 are disposed. The rotation of the reverse rollers 107 causes the paper 104 to be fed in the directions towards the front of the line printer 101, as indicated by arrow B.

In the line printer 101, the paper 104 fed in the direction indicated by arrow B passes over the paper tray 103 via spurring rollers 108, as indicated by arrow C. Finally the paper 104 is ejected out from an outlet disposed on the front of the line printer 101. A head cartridge 120 is disposed between the spurring rollers 108 and the outlet on the line printer 101 of the line printer 101, as indicated by arrow D, so that it can be replaced when necessary.

The head cartridge 120 includes the printer head 1, which has yellow, magenta, cyan, and black line heads and which is disposed below a holder 122 formed in a particular shape. Ink cartridges Y, M, C, and B, for yellow, magenta, cyan, and black inks, respectively, are disposed on the holder 122 in the order. Consequently, the line printer 101 can print color images by discharging each color ink from the respective line head onto the paper 104.

In the line printer 101, the nozzle sheet forms a unit for the four colors. As a result, each discharge nozzle is positioned accurately and the cartridge can be easily replaced.

Figure 4:
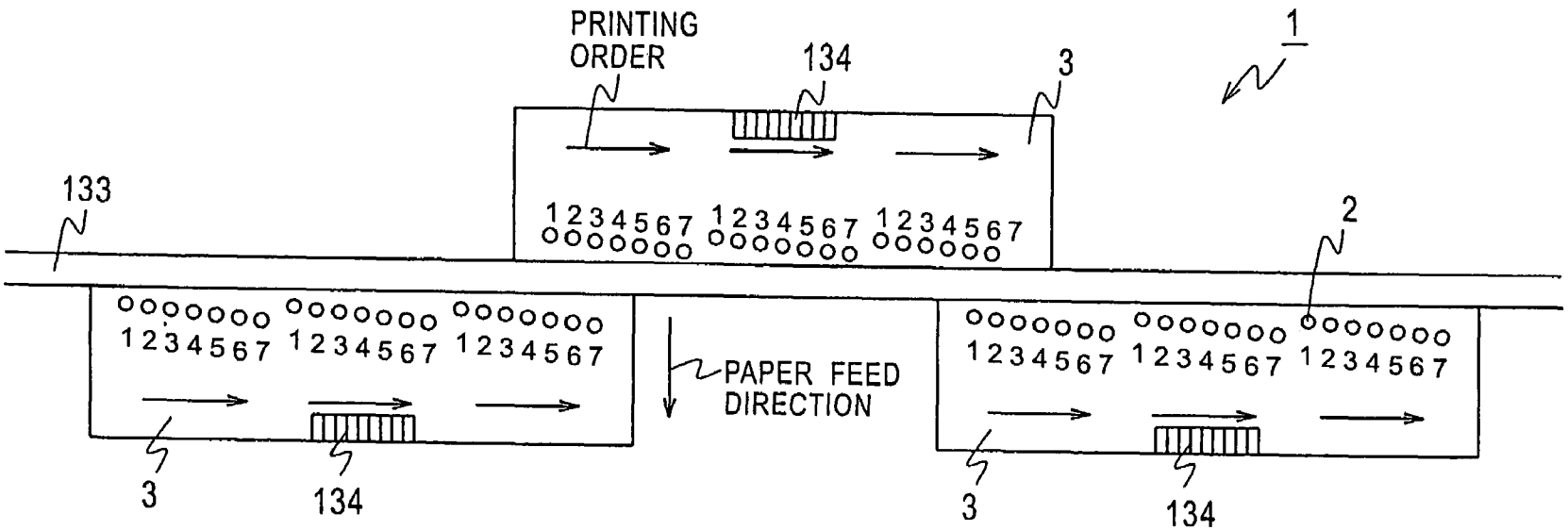
FIG. 4 is a top view describing the alignment of head chips related to the printer head of FIG. 1.

FIG. 4 describes the arrangement of head chips 3 according to this embodiment. FIG. 4 is a partially enlarged drawing of FIG. 3 from the side of the paper 104. As shown in FIG. 4, identical head chips 3 are alternately (in a zigzag pattern) disposed on the nozzle sheet 7, on both sides of ink channel 133 for each color ink. Each head chip 3 is disposed so that the heater elements 8 are located on the ink channel side. In other words, the head chips 3 on one side of the ink channel 133 are arranged so that they are rotated by 180° with respect to the head chips 3 on the opposite side of the ink channel 133. Thus, for each color, ink may be supplied to each head chip 3 via one ink channel 133 system. As a result, high resolution may be achieved for the printing using a simple structure.

Each of the pads 134 are disposed approximately in the middle of the head chips 3, in the direction the nozzles 2 are aligned (the direction perpendicular to the direction of the paper is fed), and are rotated by 180° C. relative to each other so that the distance between each pad 134 becomes equal. Consequently, flexible wiring boards connected to the pads 134 of the neighboring head chips 3 of the printer head 1 are prevented from being too close to each other. In other words, the flexible wiring boards are prevented from being concentrated in one region.

When the nozzles 2 are rotated as described above, the driving sequence, in response to a driving signal, of the group of heaters 8 on the head chips 3 disposed on the upper side of the ink channel 133 is reversed with respect to the groups of heaters 8 on the lower side. According to this embodiment, the driving sequence of heaters 8 for each of the head chips 3 may be switched to a driving sequence corresponding to the heaters 8 disposed on the head chips 3 on each side of the channel 133.

(1-2) Operation of the First Embodiment

On the semiconductor substrate 3, which has driving elements, of the printer head 1, the walls 5 of the liquid chambers 4 and the walls 6 of the liquid channels are formed of cyclized rubber, which is a patternable, adhesive elastic material. The nozzle sheet 7 is pressed and held against the walls 5 and 6. In this way, on the printer head 1, the nozzle sheet 7 is fixed to the substrate 3 with cyclized rubber, which is a patternable, adhesive elastic material.

For the printer head 1 that is formed in this way, ink is supplied to the liquid chambers 4 through the liquid channels. The pressure inside the liquid chambers 4 is changed by driving the heater elements 8. Due to the change in pressure, ink droplets are discharged from the nozzles 2 of the nozzle sheet 7. The printer operates to attach the ink droplets discharged from the nozzles 2 to the printing stock.

Long-term use of the printer head 1 causes the walls 5 and 6 of the liquid chambers 4 and liquid channels to be exposed to ink. This exposure to ink may result in erosion or swelling, causing the adhesive strength between the nozzle sheet 7 and the walls 5 and 6 to decrease. Furthermore, crosstalk may occur between neighboring liquid chambers 4.

This embodiment, however, uses cyclized rubber, which is a patternable, adhesive elastic material, for forming the walls 5 and 6 of the liquid chambers 4 and the liquid channels. By fixing the nozzle sheet 7 to the substrate 3 with cyclized rubber, sufficient adhesiveness between the nozzle sheet 7 and the end faces of the walls 5 and 6 is maintained. Also, a decrease in adhesive strength can be effectively prevented by reducing stress caused by heating cycles. As a result, crosstalk between neighboring liquid chambers 4 can be prevented effectively, and the decrease in reliability with long-term use can be reduced effectively as well.

In this embodiment, the walls 5 and 6 of the liquid chambers 4 and the liquid channels are formed of cyclized rubber, which is a patternable, adhesive elastic material. Thus, erosion and swelling of the walls 5 and 6 are prevented as a result of the chemical resistance of the cyclized rubber. As a result, a decrease in adhesiveness due to erosion and swelling may be sufficiently prevented, and, furthermore, a decrease in reliability with long-term use may be effectively prevented.

By forming the walls 5 and 6 of the liquid chambers 4 and the liquid channels with cyclized rubber, which is a patternable, adhesive elastic material, the liquid chambers 4 and liquid channels may be formed with high precision by applying various micro fabrication techniques. As a result, deterioration of printing precision due to the difference in the fabrication of each liquid chamber 4 and liquid channel may be reduced and the difference in the quality of each finished product will thus be small.

By forming the printer head 1 according to the present invention with cyclized rubber, which is a photosensitive resist, or of polyisoprene rubber, which has shown good performance as a photosensitive material, the liquid chambers 4 and the liquid channels may be formed with high precision by photolithography, which is a type of micro fabrication technique. Thus, the entire process from forming the silicon substrate 3 to forming the liquid chambers 4 and the liquid channels may be carried out by semiconductor manufacturing processes. As a result, sufficient reliability of the printer head may be acquired through a simple manufacturing process.

(1-3) Effects of First Embodiment

According to this embodiment, the walls 5 and 6 of the liquid chambers 4 and the liquid channels are formed of cyclized rubber, which is a patternable, adhesive elastic material. The nozzle sheet 7 is pressed and held against these walls 5 and 6. Consequently, by fixing the nozzle sheet 7 to the substrate 3 with cyclized rubber, which is a patternable, adhesive elastic material, a decrease in reliability with use is effectively prevented.

Since the cyclized rubber is polyisoprene rubber, sufficient reliability may be acquired. Furthermore, sufficient reliability may be acquired for the photosensitive resist, which is subjected to photolithography.

The photosensitivity of the cyclized rubber easily enables the walls of the liquid chambers and the liquid channels to be intricately formed with high precision by photolithography.

By forming the walls of the liquid chambers and the liquid channels by photolithography, the liquid chambers may be intricately formed with high precision by applying a semiconductor manufacturing process.

(2) Second Embodiment

This embodiment is the same as the first embodiment except that, instead of using polyisoprene rubber as the cyclized rubber, polybutadiene rubber is used.

Similar to polyisoprene rubber, which is cyclized rubber, polybutadiene rubber has a strong adhesive strength, stable properties, and a high chemical resistance. Moreover, polybutadiene rubber is a patternable, elastic material that is suitable for micro fabrication. Polybutadiene rubber may be used as a photosensitive resist by adding bis-azide compounds as a photosensitive group. In this embodiment, photosensitive cyclized rubber is used to form walls 5 and 6 of liquid chambers 4 and liquid channels by photolithography. A nozzle sheet 7 is pressure-fixed to the walls formed of photosensitive cyclized rubber.

A bis-azide compound, which is a photosensitive group of polybutadiene, becomes a nitrene radical by evolving nitrogen gas when irradiated with ultraviolet rays. Then the double bonds of the cyclized rubber undergo a crosslinking reaction, i.e. H-abstraction, and bonding reactions between the nitrene radicals occur, causing the portions exposed to ultraviolet rays to be selectively made insoluble in liquid developer. The exposure wavelength of bis-azide compounds is about 230 to 480 [nm]. In particular, 2,6-di(4'-azidobenzylidene)-4-cyclohexanone and 2,6-di(4'-azidobenzylidene)-4-methylcyclohexanone have high response speed and are widely used materials.

According to this embodiment, the same effects as the first embodiment may be acquired even if polybutadiene is used as the cyclized rubber instead of polyisoprene rubber, which is used in the first embodiment.

(3) Third Embodiment

Figure 5:
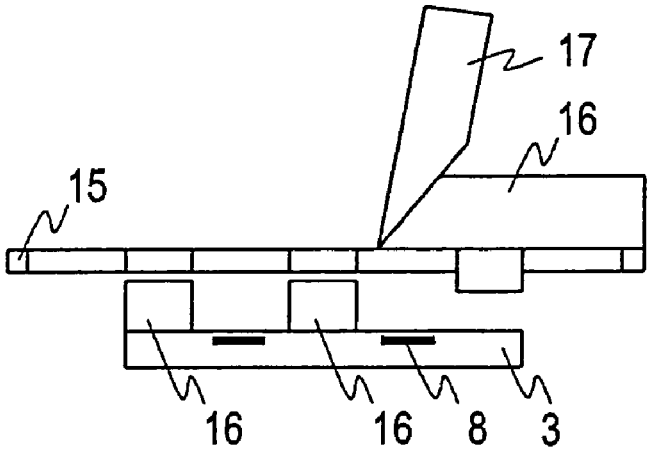
FIG. 5 is a cross-sectional view describing the manufacturing process of a printer head according to a third embodiment of the present invention.

As shown in FIG. 5, in this embodiment, walls of liquid chambers and liquid channels are formed with cyclized rubber by applying screen printing, which is a type of patterning and printing technique.

On a screen 15, which is patterned in the same way as the shape of the walls, cyclized rubber 16, in the formed of a resist paste, is disposed. By moving a squeegee 17, the cyclized rubber 16 is applied in the shape of the walls of the liquid chambers and liquid channels. After letting the solvent dry, processing such as baking is performed, if required, and the walls are formed by crosslinking. For these processes, the mesh for the screen 15 is selected depending on the precision of the walls. Furthermore, the positioning and gap between the screen 15 and the substrate 3, the tilt and the pressure of the squeegee 17, and the viscosity of the cyclized rubber 16 are optimized.

In this embodiment, a nozzle sheet 7 is pressure-fixed, in the same way as described in the first embodiment, onto the walls formed as described above.

As shown in FIG. 5, by forming the walls of the liquid chamber and the liquid channels with cyclized rubber by screen printing, in addition to the effects of the first embodiment, the walls of the liquid chambers and the liquid channels may be formed even more efficiently.

(4) Fourth Embodiment

In this embodiment, as shown in FIGS. 6(A) to 6(F), walls of liquid chambers and liquid channels are formed with cyclized rubber by pad printing, which is an intaglio transfer method for intaglio printing and which is both a patterning method and a printing method.

Figure 6:
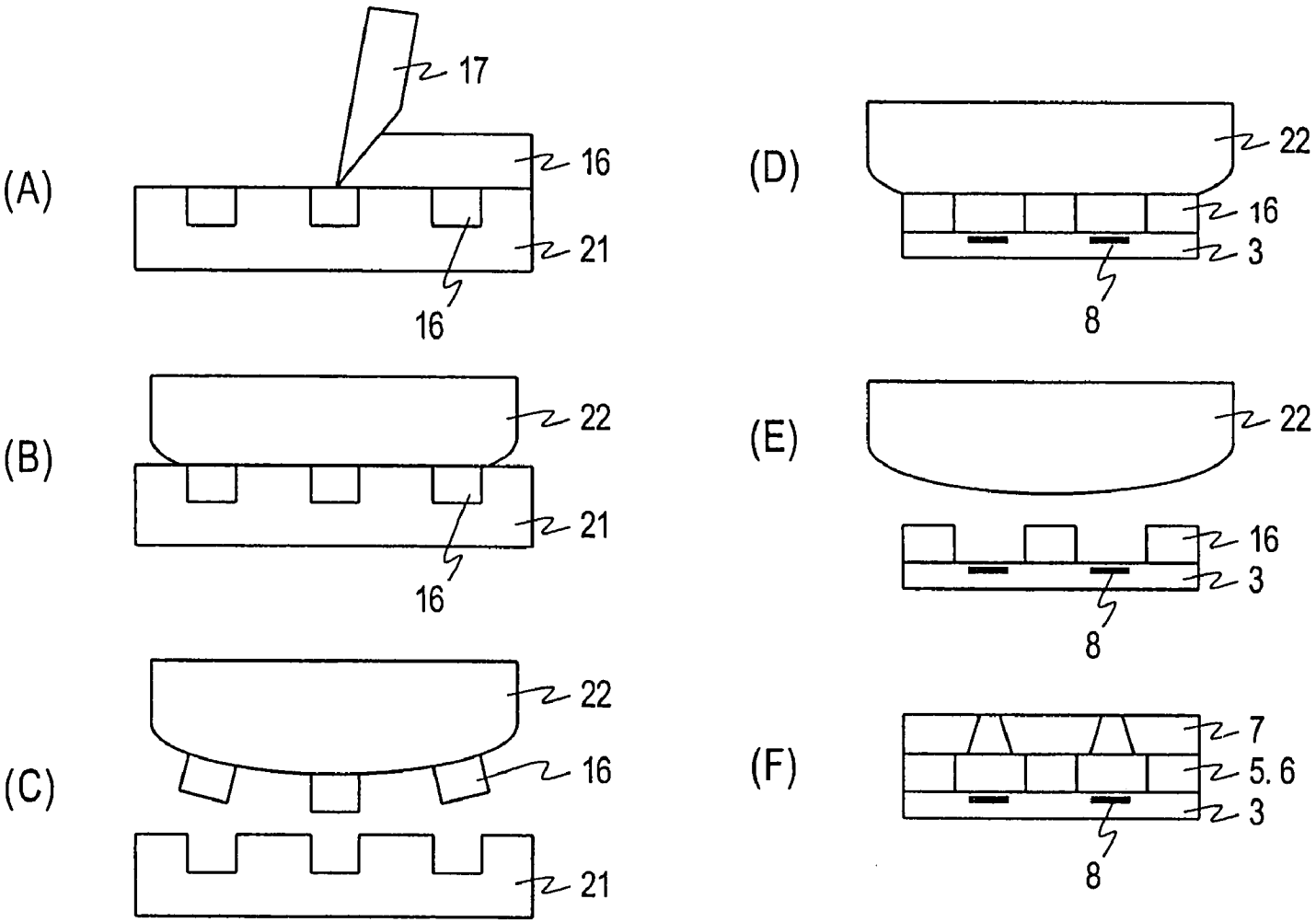
FIGS. 6(A), 6(B), 6(C), 6(D), 6(E), and 6(F) are cross-sectional views describing the manufacturing process of a printer head according to a fourth embodiment of the present invention.

As shown in FIG. 6(A), a predetermined amount of cyclized rubber 16 is applied on an intaglio 21, which is formed by the depressed portions of walls. Then a squeegee 17 is moved to fill these depressed portions of the intaglio 21 with cyclized rubber 16, and the excess cyclized rubber 16 is scraped off.

As shown in FIG. 6(B), the intaglio 21 is pressed against a transfer pad 22. Then, as shown in FIG. 6(C), the transfer pad 22 is pulled apart from the intaglio 21 at a predetermined rate. As a result, the cyclized rubber 16 filled in the depressed portions of the intaglio 21 is transferred to the transfer pad 22.

After moving the transfer pad 22 over a substrate 3, the transfer pad 22 is pressed onto the substrate 3, as shown in FIG. 6(D). Then, as shown in FIG. 6(E), by pulling the transfer pad 22 apart from the substrate 3, the cyclized rubber 16, which is shaped according to the shape of the walls on the transfer pad 22, is transferred onto the substrate 3. After letting the solvent of the cyclized rubber 16 dry, processing such as baking is performed, if required, and the walls 5 and 6 are formed by crosslinking. In this process, instead of moving the transfer pad 22, the intaglio 21 and the substrate 3 may be moved. Each condition is optimized to position the intaglio 21, the transfer pad 22, and the substrate 3, according to the required precision.

As shown in FIG. 6(F), on the walls 5 and 6 formed as described above, a nozzle sheet 7 is pressure-fixed as described in the first embodiment.

Even if the walls 5 and 6 are formed with cyclized rubber 16 by intaglio printing, as shown in FIGS. 6(A) to 6(F), the same effects as described in the third embodiment may be acquired.

(5) Fifth Embodiment

In this embodiment, as shown in FIGS. 7(A) to 8(H), walls of liquid chambers and liquid channels are formed by alternately stacking cyclized rubber and a predetermined resin. In this embodiment, a nozzle sheet is fixed to a substrate with cyclized rubber, which is a patternable, adhesive elastic material.

The walls of the liquid chambers and the liquid channels are formed with photosensitive resin by photolithography, wherein the cyclized rubber and the resin are simultaneously patterned.

By forming the walls of the liquid chambers and the liquid channels with alternating layers of adhesive elastic material and predetermined resin and by fixing the nozzle sheet to the substrate with this elastic material, even if the resin deforms due to swelling, the deformation is compensated for by the deformation of the elastic material. As a result, gaps do not form between the nozzle sheet and the walls. Furthermore, stress caused by head cycles may be alleviated. Since the elastic material is adhesive, gaps do not form between the walls and the nozzle sheet compared to walls formed of known resins. Consequently, a decrease in reliability with extended use is prevented.

Since the elastic material is patternable, intricate ink chambers and channels may be formed with high precision. Moreover, since the resin is photosensitive, after forming the bottom half of the walls by a semiconductor manufacturing process, the upper halves of the walls may be formed by stacking cyclized rubber on the bottom halves of the walls by various methods. By forming the walls of the liquid chambers and the liquid channels by simultaneously patterning the cyclized rubber and resin by photolithography using activation energy, walls with alternately stacked layers may be efficiently formed.

Figure 7:
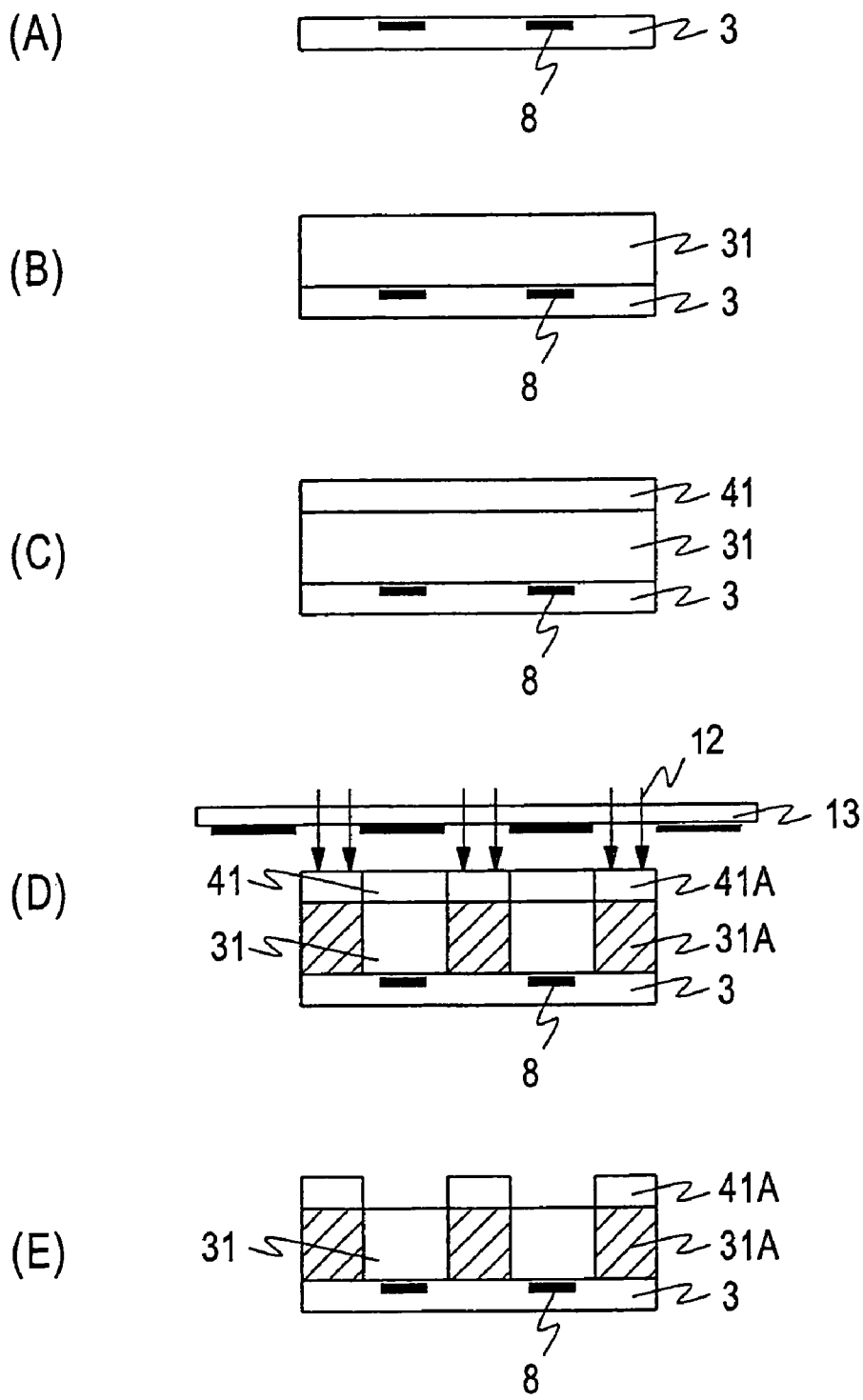
FIGS. 7(A), 7(B), 7(C), 7(D), and 7(E) are cross-sectional views describing the manufacturing process of a printer head according to a fifth embodiment of the present invention.
Figure 8:
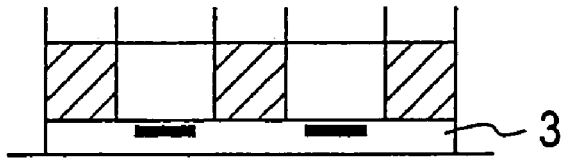
FIGS. 8(F), 8(G), and 8(H) are cross-sectional views describing the manufacturing process subsequent to FIG. 7(E).
Figure 8:
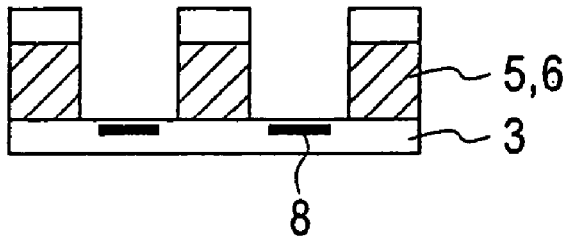
Figure 8:
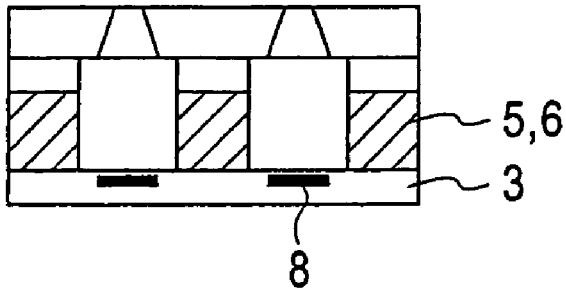
Figure 9:
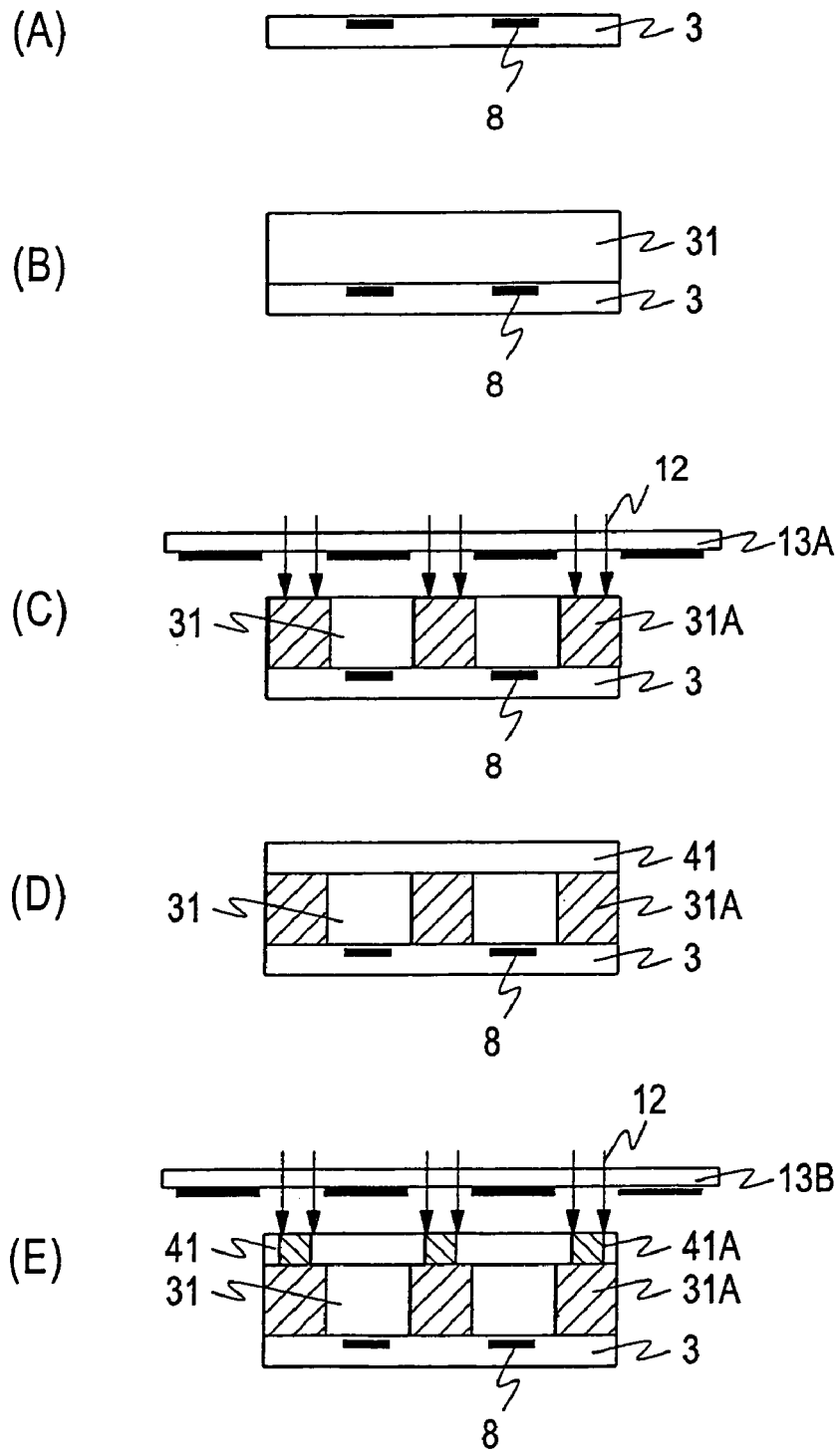
FIGS. 9(A), 9(B), 9(C), 9(D), and 9(E) are cross-sectional views describing the manufacturing process of a printer head according to a sixth embodiment of the present invention.
Figure 10:
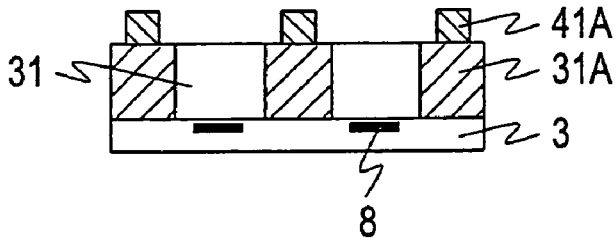
FIGS. 10(F), 10(G), 10(H), and 10(I) are cross-sectional views describing the manufacturing process subsequent to FIG. 9(E).
Figure 10:
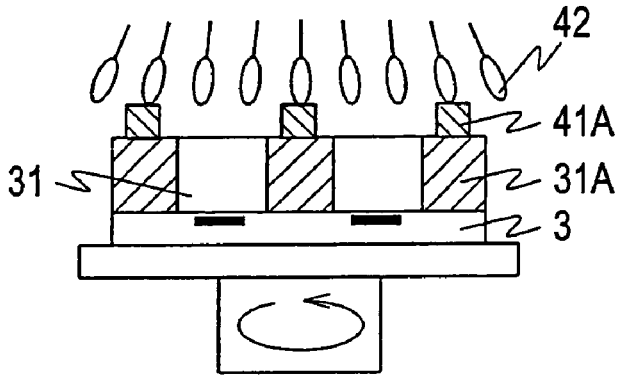
Figure 10:
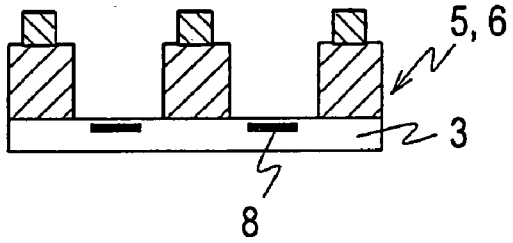
Figure 10:
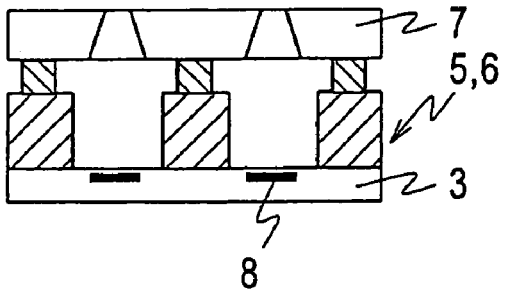

FIGS. 7(A) to 8(H) are cross-sectional drawings describing the manufacturing processes of a printer head according to this embodiment. As shown in FIG. 7(A), similar to the first embodiment, driving elements 8 and other parts are formed on a substrate 3. Further, if required, the surface is treated and modified.

As shown in FIG. 7(B), a photosensitive resin 31, which forms the bottom halves of the walls, is applied onto the substrate 3 with a predetermined thickness. To apply the photosensitive resin 31, various application methods used in semiconductor manufacturing processes such as spin coating, bar coating, or curtain coating may be used. For the photosensitive resin 31, photosensitive epoxy resin and its derivatives, photosensitive acrylic resin and its derivatives, or photosensitive polyimide and its derivatives are suitable. The resin is not limited to the resins mentioned above, however, as long as the resin does not swell or erode due to the ink. Then, depending on the resin, the solvent is allowed to dry and the substrate 3 is heated to stabilize the resin film.

As shown in FIG. 7(C), a resist layer 41 is formed with photosensitive cyclized rubber by spin coating, bar coating, or curtain coating. Then, if required, the layer is dried or heated.

As shown in FIG. 7(D), the walls are masked with a photo mask 13, and then the layer of photosensitive resin 31 and the resist layer 41 are both exposed to activation energy 12 at once. (In FIG. 7(C), the regions exposed are indicated by reference numerals 31A and 41A). The activation energy 12 may be ultraviolet rays, an electron beams, or X-rays, which are all used for photolithography. In this embodiment, ultraviolet ray exposure equipment is used to irradiate the resist film 31 and the resist layer 41, which are photosensitive to 280 [nm] to 480 [nm]. When irradiating materials arranged in two layers, as described above, each layer may have a different sensitivity to the wavelength of the activation energy 12. Therefore, when irradiating both layers at once, the exposure time must be optimized.

As shown in FIG. 7(E), the unexposed areas of the resist layer 41 are removed by developing the resist layer 41 using a developer or solvent. The tips 41A of the walls 5 and 6 are formed by patterning cyclized rubber by photolithography using activation energy.

As shown in FIG. 8(F), the substrate 3 is washed by spin coating using a rinse agent 42. As shown in FIG. 8(G), the unexposed areas of the resist layer 31 are removed by developing the resist layer 31 using a developer or solvent. As a result, the walls 5 and 6 are formed.

Instead of individually developing the layers 31 and 41, the layers 31 and 41 may be developed together at once by using a polar solvent such as propyleneglycol monomethyl ether acetate (PGMEA). In this way, the processes described in FIGS. 7(E) and 8(F) may be omitted, and, consequently, the manufacturing process may be simplified.

As shown in FIG. 8(H), the nozzle sheet 7 is positioned and fixed by the adhesiveness of the patterned material forming the liquid channels. To fix the nozzle sheet 7, the sheet may be pressed and bonded, or the adhesiveness of the sheet may be improved by supplying energy such as heat, light, or an electron beam to the bonded nozzle sheet. The nozzle sheet 7 may be pressed against the walls while energy such as heat, light, or and an electron beam is supplied.

By forming the walls of the liquid chambers and liquid channels by alternately stacking cyclized rubber and a predetermined resin and, then, fixing the nozzle sheet onto the substrate with this cyclized rubber, which is a patternable, adhesive elastic material, the same effect as described in the first embodiment may be acquired. Since an appropriate resin can be selected, the degree of freedom of the selected material is improved.

By using photosensitive resin, the bottom halves of the walls may be formed by patterning the resin by photolithography using activation energy.

The cyclized rubber and resin are patterned simultaneously by photolithography using activation energy to form the walls of the liquid chambers and the liquid channels. In this way, even though the walls are formed by stacking layers, the walls may be formed by a semiconductor manufacturing process.

After simultaneously exposing the cyclized rubber and resin, the cyclized rubber and resin are developed individually or integrally. In this way, patterning suitable for the resin may be performed as required.

(6) Sixth Embodiment

In this embodiment, as shown in FIGS. 9(A) to 10(I), to form walls of liquid chambers and liquid channels by alternately stacking cyclized rubber and resin, the cyclized rubber and resin are exposed individually. In this embodiment, the resin used is the same resin as in the fifth embodiment. Therefore, descriptions for structures that are the same as those of the fifth embodiment are omitted.

More specifically, similarly to the fifth embodiment, as shown in FIG. 9(A), driving elements and others are formed on the substrate and, then, as required, surface treatment and surface modification are performed. As shown in FIG. 9(B), photosensitive resin 31, which forms the bottom halves of the walls, is applied onto the substrate 3 with a predetermined thickness.

As shown in FIG. 9(C), the walls are masked in the shape of the bottom halves of the walls with a photo mask 13A, and the resist film 31 is irradiated with activation energy. The activation energy 12 may be ultraviolet rays, electron beams, or X-rays, which are all used for photolithography. When the resin 31 is a chemically amplified resin, after exposure, post-exposure baking (PEB) must be performed because of the pattern amplification due to the generated acid. Post-exposure baking may be performed during the exposure process or may be performed during any suitable process described later. Also, to stabilize the exposure film or to accelerate the polymerization of the exposed parts of the resin, the substrate 3 may be heated.

As shown in FIG. 9(D), the resist layer 41 made up of photosensitive cyclized rubber is formed by various application methods such as spin coating, bar coating, or curtain coating may be used and then, if required, dried and heated.

As shown in FIG. 9(E), the resist layer 41 is exposed while using the photo mask 13B. For exposure, any suitable type of activation energy 12 may be selected. The photo mask 13B may have the same pattern as the photo mask 13A used for exposing the film of resin 41, or the photo mask 13B may have a smaller width compared to the width of the photo mask 13A.

As shown in FIG. 10(F), the resist layer 41 is developed using specific liquid developers and solvents. Then the unexposed areas are removed from the resist layer 11. By patterning the cyclized rubber by photolithography using activation energy 12, the tips 41A of the walls 5 and 6 are formed.

As shown in FIG. 10(G), the substrate 3 is washed by spin coating using a rinse agent 42. As shown in FIG. 10(H), the unexposed areas of the resin layer 31 are removed by developing the resin layer 41 using a developer or solvent. As a result, the walls 5 and 6 are formed. For this embodiment, instead of developing layers 31 and 41 individually, these layers 31 and 41 may be developed at once. In this way, the processes described in FIGS. 10(F) and 10(G) may be omitted, and, consequently, the manufacturing process may be simplified.

As shown in FIG. 10(I), the nozzle sheet 7 is positioned and pressure-fixed. In this way, the nozzle sheet 7 is fixed by the adhesiveness of the patterned material forming the liquid channels. To fix the nozzle sheet 7, the sheet may be pressed and bonded, or the adhesiveness of the sheet may be improved by supplying energy such as heat, light, or an electron beam to the bonded nozzle sheet. The nozzle sheet 7 may be pressed against the walls while energy such as heat, light, or an electron beam may be supplied.

By forming the walls of the liquid chambers and the liquid channels by alternately stacking cyclized rubber and a predetermined resin and, then, fixing the nozzle sheet onto the substrate with this cyclized rubber, which is a patternable, adhesive elastic material, the same effect as described in the first embodiment may be acquired. Since each layer is exposed individually, any appropriate resin can be selected, and, thus, the degree of freedom of the selected material is improved.

(7) Seventh Embodiment

In this embodiment, walls of liquid chambers and liquid channels are formed by stacking cyclized rubber and a predetermined resin. After processing the predetermined resin into the shapes of the walls, the cyclized rubber is stacked onto the end faces of the resin by printing to form the walls of the liquid chambers and the liquid channels. Screen printing may be used for this process.

In this embodiment, the walls 5 and 6 of the liquid chambers 4 and the liquid channels are formed on the substrate 3 with a predetermined resin in the same manner as in a known process. For the resin, an appropriate resin may be selected from the resins mentioned in the fifth embodiment.

Figure 11:
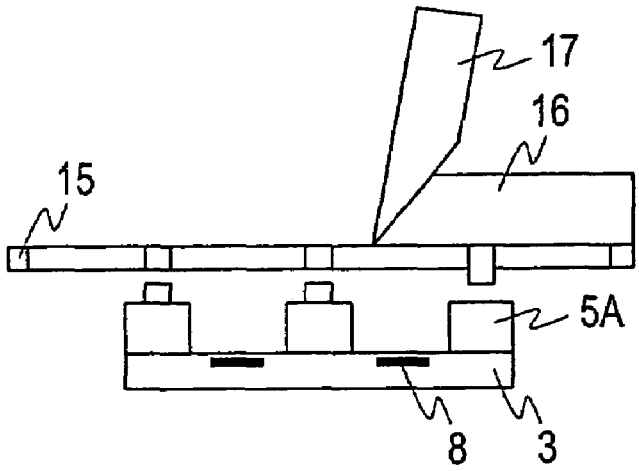
FIG. 11 is a cross-sectional view describing the manufacturing process of a printer head according a seventh embodiment of the present invention.

As shown in FIG. 11, the substrate 3 with walls 5A is positioned and fixed on a screen printer composed of a predetermined screen 15 and cyclized rubber 16 disposed on the screen 15. Then by moving a squeegee 17, the cyclized rubber 16 is applied to the end faces of the walls 5A. After letting the solvent dry, a process such as baking is performed and the walls are formed by crosslinking. A mesh for the screen 15 is selected for the process depending on the required precision of the walls. Furthermore, the positioning of and the gap between the screen 15 and the substrate 3, the tilt and the pressure of the squeegee 17, and the viscosity of the cyclized rubber 16 are optimized.

Since, in this embodiment, the walls of the liquid chambers and the liquid channels are formed by alternately stacking cyclized rubber and a predetermined resin, after the walls are preformed by resin, the cyclized rubber may be stacked by screen printing. In this way, the same effect as in the first embodiment may be acquired. By stacking the cyclized rubber by screen printing, the cyclized rubber may be stacked after the walls are formed by known processes. Consequently, the reliability of the printer head may be improved by merely adding the screen printing process to the known processes.

(8) Eighth Embodiment

In this embodiment, cyclized rubber is stacked by intaglio printing instead of screen printing.

More specifically, as shown in FIGS. 12(A) to 12(F), which are comparable to FIGS. 6(A) to 6(F), walls 5 and 6 of liquid chambers and liquid channels are formed on a substrate 3 with a predetermined resin in a similar manner as in the seventh embodiment. As shown is FIG. 12(A), a paste of cyclized rubber 16 is applied on an intaglio 21, which is formed by the depressed portions of walls formed by the above processes. Then a squeegee 17 is moved to fill these depressed portions of the intaglio 21 with the cyclized rubber 16 and the excess cyclized rubber 16 is scraped off.

Figure 12:
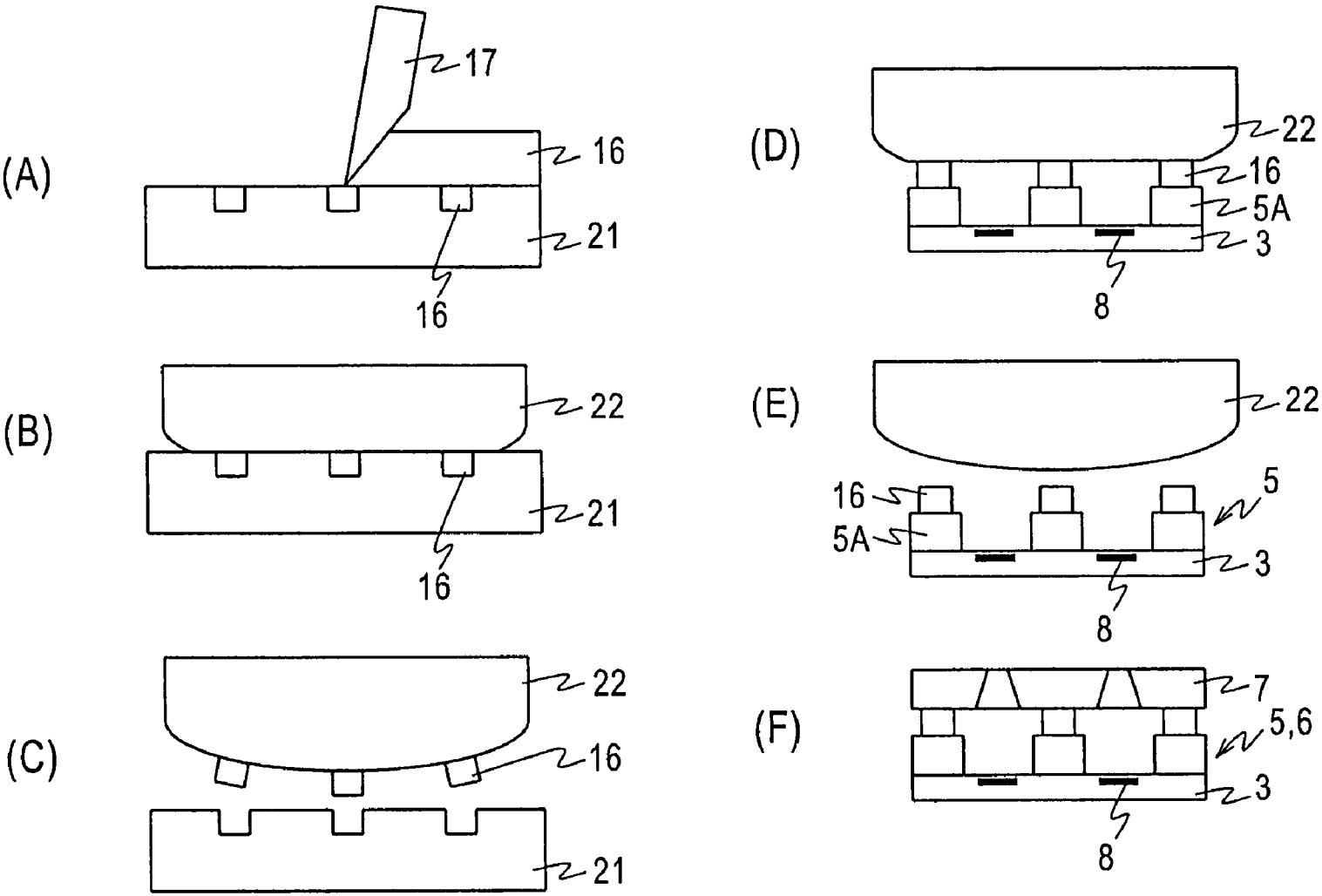
FIGS. 12(A), 12(B), 12(C), 12(D), 12(E), and 12(F) are cross-sectional views describing a printer head according to an eighth embodiment of the present invention.

As shown in FIG. 12(B), a transfer pad 22 is pressed against the intaglio 21. Then, as shown in FIG. 12(C), the transfer pad 22 is pulled apart from the intaglio 21 at a predetermined rate. As a result, the cyclized rubber 16 filled in the depressed portions of the intaglio 21 is transferred to the transfer pad 22.

After moving the transfer pad 22 onto the above substrate 3, the transfer pad 22 is pressed onto the substrate 3, as shown in FIG. 12(D). Then, as shown in FIG. 12(E), by pulling the transfer pad 22 apart from the substrate 3, the cyclized rubber 16 fixed onto the transfer pad 22 is transferred onto the end faces of walls 5A of the substrate 3. After letting the solvent of the cyclized rubber 16 dry, processing such as baking is performed and the walls 5 and 6 are formed by crosslinking. In this process, instead of moving the transfer pad 22, the intaglio 21 and the substrate 3 may be moved. According to the required precision, each condition is optimized to position the intaglio 21, the transfer pad 22, and the substrate 3.

As shown in 12(F), on the walls 5 and 6 formed as described above, a nozzle sheet 7 is pressure-fixed as described in the first embodiment.

Even if intaglio printing is used instead of screen printing, the same effects as described in the seventh embodiment may be acquired.

(9) Ninth Embodiment (9-1) Arrangement of the Ninth Embodiment

In this embodiment, walls 5 and 6 are formed with polyimide. This embodiment is the same as the first embodiment except for the structures of the walls 5 and 6. Therefore FIGS. 1 and 2(A) to 2(E) are used for the description.

For the printer head 1 according to this embodiment, a substrate 3 is formed by semiconductor manufacturing processes, wherein heater elements 8, which are driving elements for changing the pressure inside the liquid chambers 4, and driving circuits for driving these heater elements 8 are simultaneously formed on a semiconductor wafer. The wafer is divided into substrates 3, having predetermined shapes. Consequently, at the printer head 1 the pressure inside the liquid chambers 4 is changed by the heater elements 8, which are driving elements, and droplets of ink contained in the liquid chambers 4 are discharged from the nozzles 2 onto printing stock.

The nozzle sheet 7 is a nickel sheet, which is formed by electrotyping, or a polyimide sheet with heat resistance. The nickel nozzle sheet 7 formed by electrotyping allows the fine nozzles 2 to be easily formed with high precision. The polyimide nozzle sheet 7 has excellent chemical resistance, providing high reliability.

The walls 5 and 6 are entirely formed of polyimide to efficiently prevent a decrease in reliability with use. The polyimide is a block-copolymerized polyimide, which is a photoresist having sufficient adhesiveness. In this way, the walls can be formed easily by semiconductor manufacturing processes while maintaining sufficient adhesive strength.

The block-copolymerized polyimide, unlike known photosensitive polyimide, is directly synthesized into polyimide without going through the stage of polyamic acid, which is a polyimide precursor (U.S. Pat. No. 5,502,143 etc.) and which is generated by joining polymerized polyimide units (which are called a block). The block-copolymerized polyimide with desired properties may be freely designed and synthesized by configuring the properties of blocks, which are minimum units. Since the block units of the block-copolymerized polyimide have already undergone polyimidization, high temperature curing, which is necessary for known photosensitive polyimide, is unnecessary. In particular, for this embodiment, desired properties for the block-copolymerized polyimide are acquired by configuring each block.

In the manufacturing processes of the printer head 1, after forming the heater elements 8 and other parts on the semiconductor substrate 3 by a semiconductor process (FIG. 2(A)), the surface of the substrate 3 is treated and modified if required. Then, a material layer for improving the adhesiveness between the substrate 3 and the walls 5 and 6 is formed on the substrate 3. To improve the adhesiveness of the material layer, various materials that are used for this type of processing may be used.

As shown in FIG. 2(B), a photoresist made of block-copolymerized polyimide is applied onto the substrate 3 with a predetermined thickness to form a resist layer 11. To apply the resist layer 11, various application methods used in semiconductor manufacturing processing such as spin coating, bar coating, or curtain coating may be used. The thickness of the resist layer 11 is arranged so that the final height of the liquid chambers 4 becomes the desired value.

As shown in FIG. 2(C), the resist layer 11 is selectively exposed to activation energy 12 to bond each block in the resist. In FIG. 2(B), the exposed area is indicated by reference number 11A. The activation energy 12 may be ultraviolet rays, electron beams, or X-rays, depending on the properties of the resist. In this embodiment, the resist layer 11 is irradiated with ultraviolet rays. In FIG. 2(C), reference number 13 indicates a photo mask.

As shown in FIG. 2(D), the resist layer 11 is developed using specific liquid developers and solvents. Then the unexposed areas are removed from the resist layer 11. By photolithography using the activation energy 12, the walls 5 and 6 of the liquid chambers 4 and the liquid channels are patterned and formed with polyimide.

As shown in FIG. 2(E), the nozzle sheet 7 is positioned and pressure-fixed. The nozzle sheet 7 is fixed by the adhesiveness of the patterned material. The adhesiveness may be strengthened by supplying energy such as heat, light, or an electron beam while the nozzle sheet 7 is being pressure-fixed to the walls.

A positive type photoresist made of block-copolymerized polyimide may also be used. In this case, the processes applied are the same as the above negative type photoresist except that the pattern of the photo mask used for exposure and the processing of the unexposed portions differ.

(9-2) Operation of the Ninth Embodiment

The printer head 1 includes the semiconductor substrate 3, which has driving elements and other parts. On the semiconductor substrate 3, the walls 5 and 6 of the liquid chambers 4 and the liquid channels are formed with polyimide. The nozzle sheet 7 is pressed and held against the end faces of the walls 5 and 6. For the printer head 1 that is formed in this way, ink is supplied to the liquid chambers 4 through the liquid channels. The pressure inside the liquid chambers 4 is changed by driving the heater elements 8. Due to the change in pressure, ink droplets are discharged from the nozzles 2 of the nozzle sheet 7. The printer operates to attach the ink droplets discharged from the nozzles 2 to the printing stock.

Long-term use of the printer head 1 causes the walls 5 and 6 of the liquid chambers 4 and the liquid channels to be exposed to ink. This exposure to ink may result in erosion or swelling, causing the adhesive strength between the nozzle sheet 7 and the walls 5 and 6 to decrease. Furthermore, crosstalk may occur between neighboring liquid chambers 4.

For the printer head 1, however, the walls 5 and 6 of the liquid chambers 4 and the liquid channels are formed with polyimide. Polyimide has a better chemical resistance compared to known epoxy resins. Thus, even if the walls 5 and 6 of the liquid chambers 4 and the liquid channels are exposed to ink, erosion and swelling can be greatly reduced compared to known materials. Consequently, peeling of the nozzle sheet 7 caused by erosion and swelling may be efficiently prevented. As a result, decrease in reliability with use may be prevented efficiently.

For the printer head 1, block-copolymerized polyimide is used to maintain sufficient adhesiveness and photosensitivity. In this way, the nozzle sheet 7 is fixed with sufficient adhesiveness by simply pressure-fixing the nozzle sheet 7. As a result, crosstalk caused by use and decrease in reliability with use may be efficiently prevented.

The photosensitivity allows the walls 5 and 6 to be patterned by photolithography. In this way, the ink chambers and the other parts may be formed with sufficiently high precision by effectively applying a semiconductor manufacturing process.

(9-3) Effects of the Ninth Embodiment

According to the above, by forming the walls of the liquid chambers and the liquid channels with polyimide, a decrease in reliability with use may be efficiently prevented.

By forming the walls with photosensitive material, the ink chambers and other parts may be formed with high precision by applying the techniques of a semiconductor manufacturing process. As a result, the reliability may be increased.

By forming the walls with block-copolymerized polyimide, which is a block polymerized material, properties such as photosensitivity and strong adhesiveness can be acquired easily.

(10) Tenth Embodiment

In this embodiment, instead of block-copolymerized polyimide described in the ninth embodiment, known photosensitive polyimide is used to form walls. Photosensitive polyimide is easily available on the market as an industrial material for semiconductors. Specifically, for example, the following are available: Toray Industrials Inc.'s Photoneece, Sumitomo Bakelite Co., Ltd.'s CRC Series, HD MicroSystems's PIQ/PI/HD Series.

In general, for a negative type photosensitive polyimide, photosensitive groups such as methacryloyl groups are bonded to the polyimide precursors by an ester linkage. On the other hand, a positive type photosensitive polyimide may be a polyimide containing a polyimide precursor with an o-nitrosobenzylester group as a side chain, a polyimide composed of an ester-linkage type polyimide precursor with an unsaturated compound and a benzoin ether compound, or a polyimide containing an ester linkage type photosensitive polyimide precursor with thioacetic acid.

Each of the above photosensitive polyimides is prepared from polyamic acid, which is generated by the emission of light, as a precursor. For a negative type polyimide, activation energy forms the precursors and then polymerization starts. For a positive type polyimide, the molecular composition of the parts irradiated with activation energy changes and the polyimide becomes dissolvable in developers and solvents.

In this embodiment, after a resist layer composed of photosensitive polyimide is formed on a substrate in the same manner as the ninth embodiment described above, exposure and development are performed. Different photo masks are used for positive and negative type materials.

Then the resist remaining on the substrate is baked at a predetermined temperature to be cured. In this way, a strong polyimide film is formed from the polyimide precursors. Subsequently, a nozzle sheet is bonded in the same manner as the ninth embodiment. Baking after development may be performed after the nozzle sheet is bonded.

By forming the walls with known photosensitive polyimide according to the tenth embodiment, decrease in reliability with use may be efficiently prevented by the chemical resistance of the polyimide.

(11) Eleventh Embodiment

In this embodiment, walls of liquid chambers and liquid channels are formed with polyimide by screen printing, which is a type of patterning and printing technique. The composition of this embodiment is the same as the third embodiment except that the structures of the walls differ. Therefore, FIG. 5 used to describe the third embodiment is used to describe the eleventh embodiment.

A wide range of polyimides may be used in this embodiment, such as the abovementioned block-copolymerized polyimide, photosensitive polyimide, block-copolymerized polyimide ink for screen printing, or non-photosensitive polyimide. The viscosity of the resist is adjusted to make a paste suitable for screen printing. For non-photosensitive polyimides, for example, Ube Industries Ltd.'s Upicoat (a polyimide overcoat ink) is available.

In this embodiment, a paste of resist 16 is applied onto a substrate 15, which is patterned in the shape of the walls. Then by moving a squeegee 17, the resist 16 is applied to the substrate 3 in the shape of the walls of the liquid chambers and the liquid channels. After letting the solvent dry, the walls are formed by performing curing suitable for each resist. For these processes, a mesh for the screen 15 is selected depending on the precision of the walls. Furthermore, the positioning and the gap between the screen 15 and the substrate 3, the tilt and the pressure of the squeegee 17, and the viscosity of the resist 16 are optimized.

In this embodiment, on the walls formed as described above, a nozzle sheet 7 is positioned and pressure-fixed in the same manner as in the ninth embodiment.

As shown in FIG. 5, by forming the walls of the liquid chambers and the liquid channels by screen printing, the walls may be formed with better efficiency, in addition to having the effects of the ninth embodiment.

(12) Twelfth Embodiment

In this embodiment, the walls of the liquid chambers and the liquid channels are formed with polyimide by pad printing, which is an intaglio transfer method for intaglio printing, a patterning method, and a printing method. This embodiment is the same as the fourth embodiment except that the structures of the walls differ. Therefore, to describe this embodiment, FIGS. 6(A) to 6(F) used to describe the fourth embodiment are used. The polyimide used for this embodiment may be the abovementioned block-copolymerized polyimide or photosensitive polyimide. The viscosity of the resist is adjusted to suit intaglio printing.

As shown in FIG. 6(A), a predetermined amount of resist 16 is applied onto an intaglio 21, which is formed by the depressed portions of the walls. Then, by moving a squeegee 17, the depressed portions of the intaglio 21 are filled with the resist 16 and the excess resist 16 is scraped off.

As shown in FIG. 6(B), a transfer pad 22 is pressed against the intaglio 21. Then, as shown in FIG. 6(C), the transfer pad 22 is pulled apart from the intaglio 21 at a predetermined rate. As a result, the resist 16 filled in the depressed portions of the intaglio 21 is transferred to the transfer pad 22.

After moving the transfer pad 22 over a substrate 3, the transfer pad 22 is pressed onto the substrate 3, as shown in FIG. 6(D). Then, as shown in FIG. 6(E), by pulling the transfer pad 22 apart from the transfer pad 22, the resist 16, which is shaped like the walls and is on the transfer pad 22, is transferred onto the substrate 3. Then the walls are formed by a process suitable for each resist. In the above processes, instead of moving the transfer pad 22, the intaglio 21 and the substrate 3 may be moved. According to the required precision, each condition is optimized to position the intaglio 21, the transfer pad 22, and the substrate 3.

As shown in FIG. 6(F), on the walls 5 and 6 formed as described above, a nozzle sheet 7 is pressure-fixed, as described in the ninth embodiment.

For intaglio printing, there is intaglio direct printing (direct printing) and intaglio transfer printing (intaglio offset printing). For intaglio direct printing, an intaglio is formed on a metal roller by etching or engraving. In general, intaglio direct printing enables high-speed printing mainly on paper or film. On the other hand, in intaglio transfer printing, ink is transferred once onto a rubber roller or a pad. Intaglio transfer printing is suitable for printing on an uneven surface. Pad printing is for printing on especially irregular surfaces.

In this embodiment, the substrate 3 has driving elements composed of heating elements and driving circuits for driving the driving elements. For this reason, the surface of the printing stock will be uneven at a microscopic level. Thus, for forming the walls, intaglio transfer printing is suitable. By using intaglio printing, the thickness of the ink applied on the printing stock can be made greater compared to relief printing and offset printing. By selecting an appropriate depth for the depressed portions, sufficient printing performance with respect to the actual height of the walls, which is 10 to 100 [μm], may be acquired.

By forming the walls of the liquid chambers and liquid channels by intaglio printing, as shown in FIGS. 6(A) to 6(F), the same effects as in the eleventh embodiment can be acquired.

(13) Other Embodiments

In the fourth, eighth, and twelfth embodiments, a method for forming walls by pad printing, which is a type of intaglio transfer printing, has been described. The present invention, however, is not limited to this method, and usual intaglio printing may be used or, even, intaglio direct printing may be used as long as sufficient precision for practical use may be acquired.

In the fourth, eleventh, and twelfth embodiments, methods for forming walls by screen printing and intaglio printing are described. The present invention, however, is not limited to these methods, and relief printing and flat printing may be used as long as sufficient precision for practical use may be acquired.

In the ninth embodiment, a method for disposing resist on a substrate by coating such as spin coating is described. The present invention, however, is not limited to this method. For example, if photosensitive polyimide is made into a sheet, it can be stacked onto the substrate.

In the ninth to twelfth embodiments, a method for directly fixing the nozzle sheet onto the walls with polyimide is described. The present invention, however, is not limited to this method. Instead, the nozzle sheet may be fixed with an adhesive layer. In this way, the adhesive strength of the adhesive layer will even more efficiently prevent the decrease in reliability with use.

In the above embodiment, a method for simultaneously forming driving elements and driving circuits for driving these driving elements on the substrate is described. The present invention, however, is not limited to this method and can be widely applied to cases where only the driving elements are disposed on the substrate.

In the above embodiments, a case wherein heating elements are used as driving elements is described. The present invention, however, is not limited to this case and can be widely applied in cases where piezoelectric elements are used as the driving elements.

In the above embodiments, a case wherein the present invention is applied to a printer head and a printer to discharge ink droplets is described. The present invention, however, is not limited to this case. The present invention may be applied to printer heads discharging, not only ink droplets, but also droplets of various dyes or liquids for forming protective layers, micro-dispensers discharging reagents, various measuring devices, various test equipment, or pattern-making devices discharging liquids such as chemical agents for etching protection.

According to the present invention, by fixing a nozzle sheet to a substrate with a predetermined material, which has excellent chemical resistance and adhesive strength, or, more specifically, with cyclized rubber, by fixing the nozzle sheet to the substrate with a patternable, adhesive elastic material, or by forming a walls of a liquid chambers and the liquid channels with polyimide, a decrease in reliability with use may be efficiently prevented.

INDUSTRIAL APPLICABILITY

The present invention is related to a liquid discharge head, a liquid discharge apparatus, and a method for forming a liquid discharge head, and may be applied to an inkjet printer.

The invention claimed is:

1. A manufacturing method for a liquid discharge head that is used for discharging droplets of liquid contained in liquid chambers from nozzles formed in a nozzle sheet by changing the pressure inside the liquid chambers via driving elements, the method comprising the steps of: forming walls structuring the liquid chambers and liquid channels for supplying the liquid to the liquid chambers and forming at least surfaces of the walls bonding the nozzle sheet with cyclized rubber having chemical resistance to the liquid and having sufficient adhesive strength to fix the nozzle sheet; and bonding the nozzle sheet to the walls; and wherein the walls are formed by stacking the cyclized rubber and a photosensitive resin, wherein the walls are formed by simultaneously patterning the photosensitive cyclized rubber and the resin by photolithography using activation energy.

2. A manufacturing method for a liquid discharge head that is used for discharging droplets of liquid contained in liquid chambers from nozzles formed in a nozzle sheet by changing the pressure inside the liquid chambers via driving elements, the method comprising the steps of: forming walls structuring the liquid chambers and liquid channels for supplying the liquid to the liquid chambers and farming at least surfaces of the walls bonding the nozzle sheet with cyclized rubber having chemical resistance to the liquid and having sufficient adhesive strength to fix the nozzle sheet; and bonding the nozzle sheet to the walls; and wherein the walls are formed by stacking the cyclized rubber and a photosensitive resin, wherein the walls are formed by simultaneously exposing the photosensitive cyclized rubber and the resin to activation energy and then individually or integrally developing the photosensitive cyclized rubber and the resin.

3. A manufacturing method for a liquid discharge head that is used for discharging droplets of liquid contained in liquid chambers from nozzles formed in a nozzle sheet by changing the pressure inside the liquid chambers via driving elements, the method comprising the steps of: forming walls structuring the liquid chambers and liquid channels for supplying the liquid to the liquid chambers and forming at least surfaces of the walls bonding the nozzle sheet with cyclized rubber having chemical resistance to the liquid and having sufficient adhesive strength to fix the nozzle sheet; and bonding the nozzle sheet to the walls; and wherein the walls are formed by stacking the cyclized rubber and a photosensitive resin, wherein the walls are formed by individually exposing the photosensitive cyclized rubber and the resin to activation energy and then individually or integrally developing the photosensitive cyclized rubber and the resin.

* * * * *